US009663194B2

(12) United States Patent
Ringeisen et al.

(10) Patent No.: US 9,663,194 B2
(45) Date of Patent: May 30, 2017

(54) BOUYANCY CONTROL DEVICE

(75) Inventors: Bradley R Ringeisen, Lorton, VA (US); Peter K Wu, Ashland, OR (US); Barry J Spargo, Washington, DC (US); Justin C Biffinger, Woodbridge, VA (US); Lisa A. Fitzgerald, Alexandria, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 647 days.

(21) Appl. No.: 12/700,759

(22) Filed: Feb. 5, 2010

(65) Prior Publication Data

US 2010/0199907 A1 Aug. 12, 2010

Related U.S. Application Data

(60) Provisional application No. 61/150,446, filed on Feb. 6, 2009.

(51) Int. Cl.
*B63B 22/18* (2006.01)
*B63B 22/22* (2006.01)

(52) U.S. Cl.
CPC ..... *B63B 22/18* (2013.01)

(58) Field of Classification Search
CPC ..... B63B 22/18; B63B 22/12; B63B 22/22
USPC ..... 114/330, 331, 333, 334; 441/21, 28, 29, 441/31; 446/155, 156, 161, 186
See application file for complete search history.

(56) References Cited

U.S. PATENT DOCUMENTS

| | | | | |
|---|---|---|---|---|
| 1,659,129 | A * | 2/1928 | Asaro | 446/156 |
| 3,265,388 | A * | 8/1966 | Kane, Jr. | 472/67 |
| 3,936,895 | A * | 2/1976 | Talkington | B63B 22/20 114/312 |
| 4,082,063 | A * | 4/1978 | Strickland | 119/254 |
| 4,270,381 | A * | 6/1981 | Demaray | 73/19.1 |
| 4,374,199 | A | 2/1983 | Carter | |
| 5,047,331 | A | 9/1991 | Swaine et al. | |
| 5,350,692 | A | 9/1994 | Taguchi et al. | |
| 6,036,357 | A * | 3/2000 | Van Drie | 366/332 |

(Continued)

OTHER PUBLICATIONS

Alshiyab et al., "Improvement of Biohydrogen Production under Increased the Reactor Size by C. acetobutylicum NCIMB 13357" American Journal of Environmental Sciences 5(1): 33-40, 2009.

(Continued)

*Primary Examiner* — Anthony Wiest
(74) *Attorney, Agent, or Firm* — US Naval Research Laboratory; Joseph T. Grunkemeyer

(57) ABSTRACT

A device having: a chamber having a gas inlet, a gas vent, and a liquid vent; and a float and a weight coupled to the chamber. The float has a lower density than the chamber. The weight has a higher density than the chamber. The aggregate density of the chamber, the float, and the weight is greater than the density of the chamber. The gas inlet, the gas vent, the liquid vent, the float, and the weight are positioned on the chamber such that: when the chamber is filled with and submerged in a liquid in which the chamber is neutrally-buoyant, the chamber is oriented to place the gas vent below the gas inlet; and when a gas is introduced through the gas inlet into the chamber that is filled with the liquid, the chamber pivots to raise the gas vent until a portion of the gas escapes from the chamber through only the gas vent.

9 Claims, 6 Drawing Sheets

(56) References Cited

U.S. PATENT DOCUMENTS

2006/0281158 A1 12/2006 Felder et al.
2009/0165374 A1* 7/2009 Kania et al. ..... 47/65.5

OTHER PUBLICATIONS

Antonopoulou et al., "Influence of pH on fermentative hydrogen production from sweet sorghum extract" International Journal of Hydrogen Energy 35 (2010) 1921-1928.
Chung, "Inhibitory Effects of H2 on Growth of Clostridium cellobioparum" Appl. and Environ. Microbiol., 31(3), 342-348 (1976).
Levin et al., "Challenges for biohydrogen production via direct lignocellulose fermentation" International Journal of Hydrogen Energy 34 (2009) 7390-7403.
Pattra et al., "Bio-hydrogen production from the fermentation of sugarcane bagasse hydrolysate by Clostridium butyricum International Journal of Hydrogen Energy" 33 (2008) 5256-5265.
Sen et al., "Status of Biological hydrogen production" J. Scientific & Industrial Res. 67 (2008) 980-993.
Zhang et al., "Biohydrogen production in a granular activated carbon anaerobic fluidized bed reactor" International Journal of Hydrogen Energy 32 (2007) 185-191.
Zhang et al., "Biological hydrogen production by Clostridium acetobutylicum in an unsaturated flow reactor" Water Research 40 (2006) 728-734.
Office action in U.S. Appl. No. 13/112,368 (Jun. 11, 2014).
Office action in U.S. Appl. No. 13/112,368 (Apr. 3, 2015).
Office action in U.S. Appl. No. 13/112,368 (Nov. 9, 2015).

* cited by examiner

BOUYANCY CONTROL DEVICE

This application claims the benefit of U.S. Provisional Application No. 61/150,446, filed on Feb. 6, 2009. The provisional application and all other publications and patent documents referred to throughout this nonprovisional application are incorporated herein by reference.

TECHNICAL FIELD

The present disclosure is generally related to buoyancy-controlled devices.

DESCRIPTION OF RELATED ART

Distributed autonomous sensor networks equipped with acoustic or magnetic sensors may soon be used in the littoral regions of the ocean. In order to maximize the effectiveness of the sensor network, power is required to surface each sensor periodically so that accumulated data can be communicated via RF or UHF transmission and so that the position of the sensor can be determined (communication with global positioning systems). These transmissions are impossible for submerged devices, as radio frequencies do not propagate well underwater.

Due to modern advances in electronics, which have reduced the power consumption in circuitry, aquatic persistent surveillance devices may be powered by microbial fuel cells in the foreseeable future (Tender et al., *J. Power Sources* 2008, 179, 571-575; Bond et al., *Science* 2002, 295, 483-485; Ringeisen et al., *Environ. Sci. Technol.* 2006, 40, 2629-2634). Electric generation using microbes shows promise for devices that are designed for long term deployment without servicing. Moreover, since many microbes are capable of survival in dark environments, the use of microbes for electric generation where solar power is not an option (such as underwater applications) is especially promising. The utilization of nutrients from marine environments by microbes could potentially extend the operation of the circuitry in the device indefinitely.

The ability of a submerged device to surface periodically posts a different challenge. For a device with a constant mass, to convert from a submerged to a buoyant state, the displacement of the device must change. The most common strategy is to induce a change in displacement of the device by using various methods to push water from the device, such as pumps or compressed gas. The submerged and buoyant state can be switched using multiple valves. Such a scheme requires a source of compressed gas or a pump and additional power to operate the valves and timing circuits. This increases the size, weight, and acoustic signature of the device. The operational lifespan of the device is ultimately limited by the amount of compressed gas stored or by the battery life to power the pumps and valves.

BRIEF SUMMARY

Disclosed herein is a device comprising: a chamber having a gas inlet, a gas vent, and a liquid vent; and a float and a weight coupled to the chamber. The float has a lower density than the chamber. The weight has a higher density than the chamber. The aggregate density of the chamber, the float, and the weight is greater than the density of the chamber. The gas inlet, the gas vent, the liquid vent, the float, and the weight are positioned on the chamber such that: when the chamber is filled with and submerged in a liquid in which the chamber is neutrally-buoyant, the chamber is oriented to place the gas vent below the gas inlet; and when a gas is introduced through the gas inlet into the chamber that is filled with the liquid, the chamber pivots to raise the gas vent until a portion of the gas escapes from the chamber through only the gas vent.

BRIEF DESCRIPTION OF THE DRAWINGS

A more complete appreciation of the invention will be readily obtained by reference to the following Description of the Example Embodiments and the accompanying drawings.

DETAILED DESCRIPTION OF EXAMPLE EMBODIMENTS

In the following description, for purposes of explanation and not limitation, specific details are set forth in order to provide a thorough understanding of the present disclosure. However, it will be apparent to one skilled in the art that the present subject matter may be practiced in other embodiments that depart from these specific details. In other instances, detailed descriptions of well-known methods and devices are omitted so as to not obscure the present disclosure with unnecessary detail.

Figure 1:
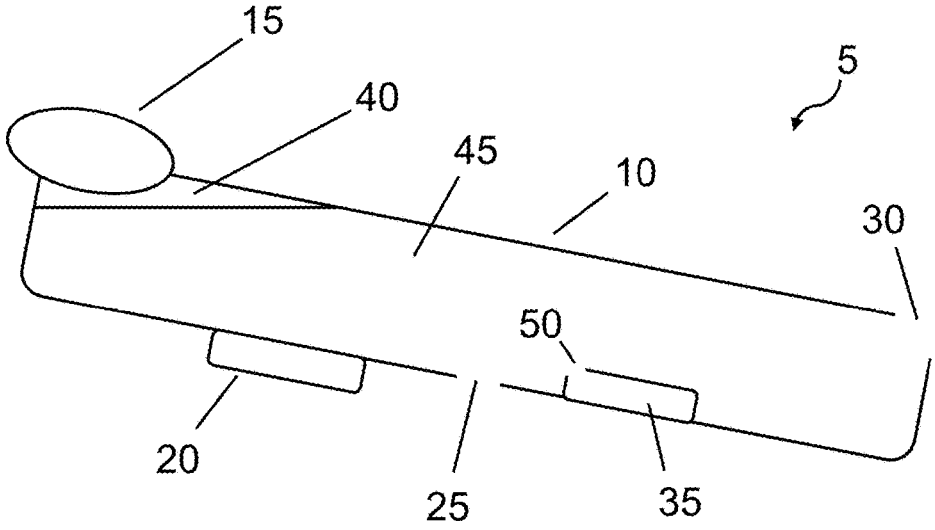
FIG. 1 schematically illustrates an embodiment of the disclosed device.

A device has been constructed and successfully tested that can periodically change from a submerged to a buoyant state using gas generated, for example, by microbes alone. The duration of the buoyant state and the switching frequency from the submerged to buoyant state can be controlled. If the type of microbes used is native to the deployment location, gas generation will not create an identifiable acoustic signature to disclose the presence and operation of the device. As shown in FIG. 1, the device 5 includes the following parts: a chamber 10, a float 15, and a counter weight ("weight") 20.

Chamber

The device chamber 10 can be of a wide variety of shapes. For the purpose of illustrating the operation of the device, a simple closed tube with two holes was used. For different device chamber shapes and sizes, the weight and location of the other parts of the device must be adjusted to accommodate the operation of the device.

To keep the description of the operation of the device simple, it is assumed that the chamber 10 is neutrally buoyant in the fluid or liquid under consideration ("liquid"). Neutrally buoyant can include, but is not limited to, having an aggregate density that is about ±5% the density of the liquid. A suitable chamber density may be in the range of about 0.5-2.0 g/mL. When the liquid is water or seawater, the density may be about 0.9-1.2 g/mL. This means that no additional force is added to the device chamber 10 by its own weight. This can be achieved in reality by attaching a weight or floatation material to the device chamber to achieve a neutrally buoyant condition. Such an added weight of floatation material is part of the chamber 10 and is distinct from the float 15 and weight 20 described below. In other words, there is no limitation to the weight, size, and shape of the chamber 10. A gas source (described below) 35 may also be neutrally buoyant if it would otherwise exert a force on the chamber.

Float

A float 15 of lower density than the chamber 10, and thus also the liquid, is attached to the device chamber 10. It can be physically attached or linked to the chamber 10 with a flexible cable, chain, string, or connection of any kind. The float anchoring point may be located toward one end of the device chamber 10 and may be on the top side of the device chamber 10. The float 15 provides a buoyant force, $F_f$, on one end of the device chamber 10. The amount of buoyant force required and the exact anchoring location of the float 15 (where the buoyant force of the float acts on the device chamber) are design parameters for customizing the operation of the device.

The chamber 10 and float 15 may designed as a continuous or integral article, with a portion thereof designated as the chamber and another portion as the float. In this case, the portion designated as the float has a lower density than the portion designated as the chamber.

In the orientation shown in FIG. 1, gas produced from the gas source 35 is trapped 40 within the device chamber 10. The device 5 will float because of the introduction of gas and thus increase in displacement. The trapped gas 40 will produce a buoyant force, $F_g$, on the device chamber 10. The location of the line-of-action of the buoyant force is a function of the amount of trappedgas 40 as well as the shape, weight, and location of all the other components in the device 5. As gas is introduced into the chamber, the fluid 45 is be expelled. A liquid vent hole 25 is located on, for example, the bottom side of the device chamber 10 for the displaced fluid to escape.

Figure 8:
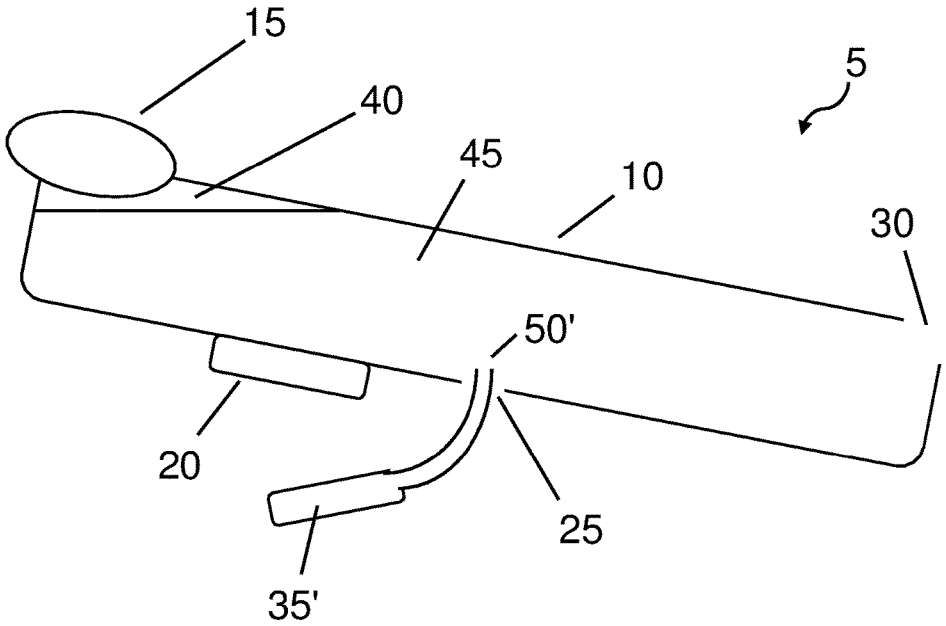
FIG. 8 schematically illustrates another embodiment of the disclosed device.
Figure 9:
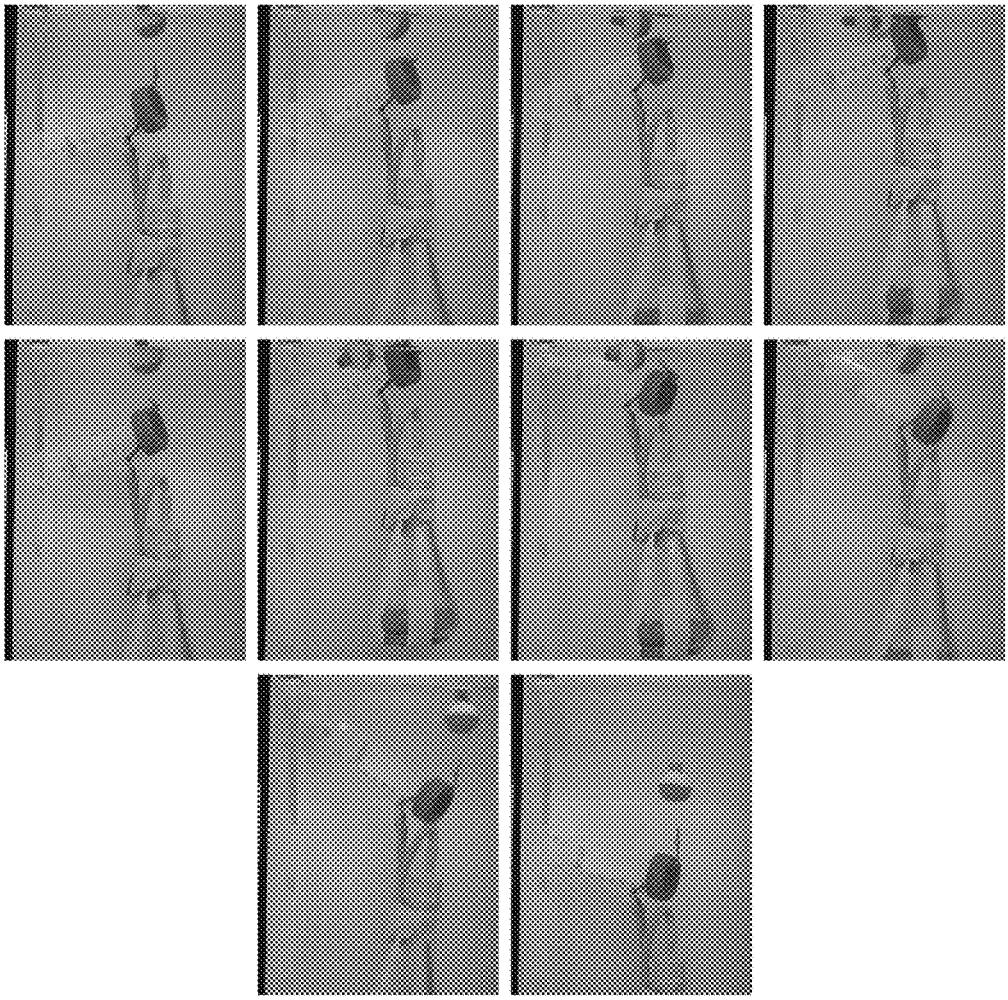
FIG. 9 shows a series of photographs of one cycle of the device rising and submerging.

During the operation of the device, a gas source 35 may be used. The gas source may be products of metabolism of microbes. The gas source 35 can be attached to the device chamber 10 in any convenient location and by any convenient method but the gas must become trapped in the chamber. The gas enters the chamber through a gas inlet 50, which may protrude through the liquid vent or may be a separate hole in the chamber. FIG. 8 shows an embodiment where gas inlet 50' is coupled to a gas source 35' outside the chamber 10 and protrudes through the liquid vent 25.

For the device 5 to transition to a submerged state, the trapped gas 40 is removed. A gas vent hole 30 may be located on the top side of the device chamber 10 and on the side of the device chamber opposite to the attachment point of the float 15.

Weight

A weight 20 of higher density than the chamber 10, and thus also the liquid, is used to create a downward force to the device 5. For convenience of demonstration here, it is attached to the bottom of the device chamber 10. The weight can be designed to be attached in different locations. It can be part or all of the device chamber and/or the gas source. It can be physically attached or linked to the chamber with a flexible cable, chain, or string. As with the float 15, the chamber 10 and weight 20 may designed as a continuous or integral article, with a portion thereof designated as the chamber and another portion as the weight. In this case, the portion designated as the weight has a higher density than the portion designated as the chamber.

A payload, such as a sensor, a communications device, or a global positioning system device can be part or all of the device chamber 10, float 15, weight 20, or the gas source 35. It can also be a separate unit 55 attached directly or through a cable, string, chain, or any connector. It can be of any size, shape, and weight. None of these attributes are a limiting factor to the operation of the device.

No payload is illustrated, but if present it can be part or all of the device chamber 10, float 15, weight 20, or the gas source 35. It can also be a separate unit attached directly or through a cable, string, chain, or any connector. It can be of any size, shape, and weight. None of these attributes are a limiting factor to the operation of the device.

Figure 2:
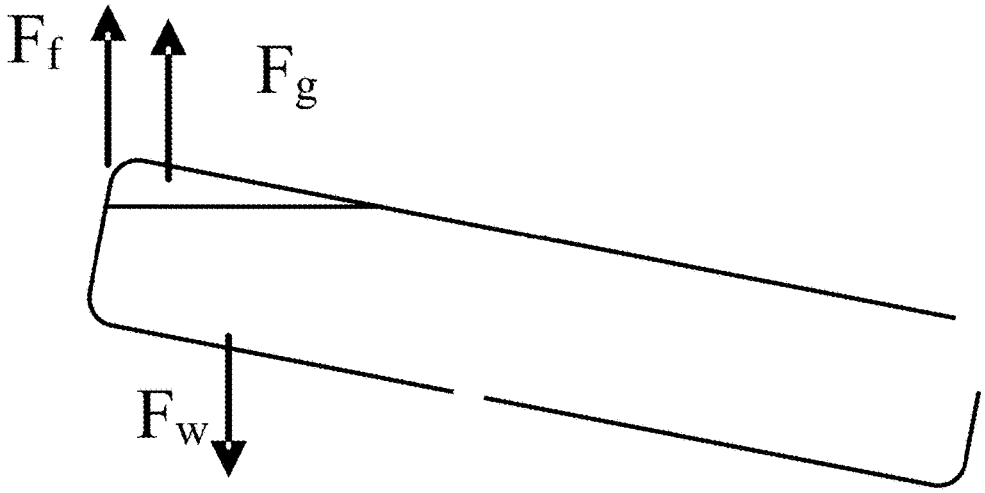
FIG. 2 shows a free-body-diagram of the proposed device with a neutrally buoyant chamber and gas source.

The total force acting on the device consists of three forces: the buoyant forces from the float, $F_f$, the trapped gas, $F_g$, and the weight, $F_w$. No other forces are present because of the physically achievable condition that the device chamber and the gas source are neutrally buoyant. A simple free-body-diagram can be drawn and is shown in FIG. 2.

Operation of the Device

To understand the operation of the device, the behavior of the device chamber is examined as gas is being introduced to the chamber starting from the condition of no trapped gas. In each case, the free-body diagram is examined to determine the behavior of the device. The magnitude of the counter weight is required to be larger than that of the buoyant force, $|F_w|>|F_f|$. This means that without the presence of trapped gas, the device chamber will sink. In other words the aggregate density of the chamber, the float, and the weight is greater than the density of the chamber, and thus of the liquid.

1. Initial Condition—No Trapped Gas

Figure 3:
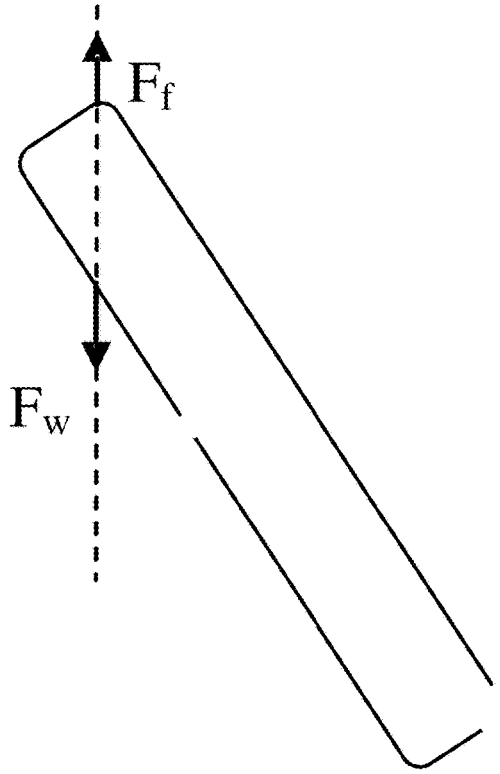
FIG. 3 shows the initial equilibrium condition with no trapped gas; only two forces are present and they lie on a vertical line.

Because there is no trapped gas, i.e., $F_g=0$, the device chamber will rotate until the direction of $F_w$ and $F_f$ are opposite to each other in the vertical position (FIG. 3). Because of the location of the anchoring points of the float and the weight, the device chamber is tilted to one side with the gas vent hole rotated toward the bottom of the float chamber. Because $|F_w|>|F_f|$, the device has a net force pointing down and will sink.

Any gas supplied by the gas source will be trapped in the top closed end of the device. The presence of gas will have two effects on the device chamber: First, the net force pointing down will be reduced because $F_g$ should always point up. Second, because of the asymmetry of the trapped gas volume, the device will rotate to achieve a zero net torque.

2. Some Trapped Gas but the Net Force Still Points Down.

Figure 4:
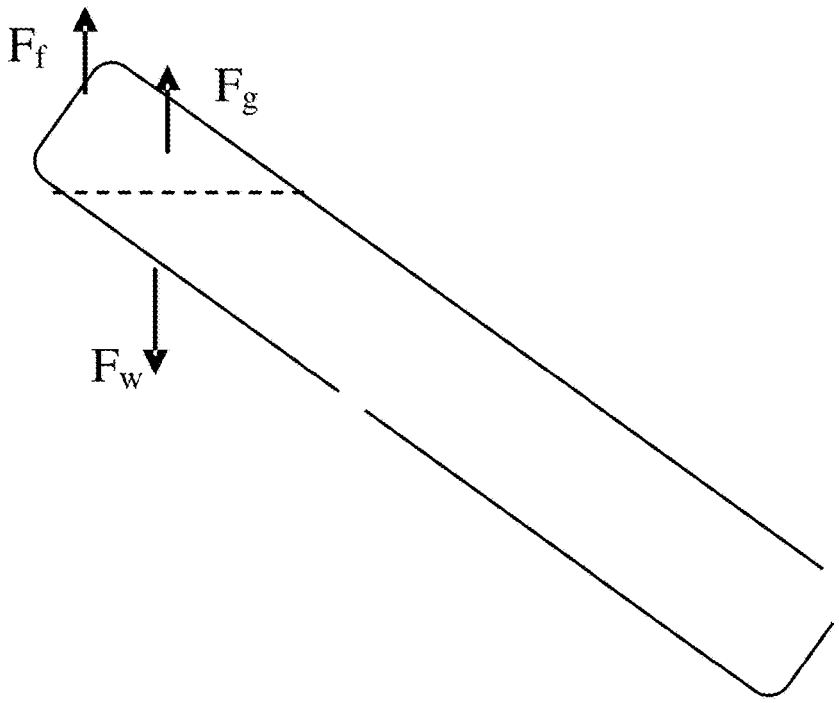
FIG. 4 shows the free-body-diagram after a small amount of gas is trapped in the device chamber; the net downward force is reduced and the device chamber is rotated.

As gas enters the device chamber, a buoyant force, $F_g$, is introduced. The line-of-action for $F_g$, should be pointing upward and through the center of gravity of the trapped gas volume. The free body diagram is shown in FIG. 4.

The resultant of the three forces is a reduction in the net downward force and a rotation of the device chamber because of the asymmetry in the trapped gas volume. The device will remain submerged as long as $F_w>F_g+F_f$.

3. More Gas is Trapped and $F_w=F_g+F_f$, but the Device Chamber is Still Tilted Down to the Right.

At this point the whole device is neutrally buoyant and further introduction of gas will result in a net force pointing up. The device will begin to rise as more gas is trapped. The location of the anchors for the float and weight are chosen such that the gas vent hole is still on the down side of the device chamber.

The time it takes for the device chamber to reach this condition depends on the rate of gas input, the shape and size of the device chamber, and the magnitude and location of $F_w$ and $F_f$. These and other factors determine the total submerged time of the device.

4. More Gas is Trapped and $F_g$ Continues to Move Away from $F_f$. At Some Point the Torque Produced by $F_g$ is Greater than that of $F_f$, the Device Chamber Will Start to Rotate Such that the Right Side of the Chamber is Pointing Up.

As the device chamber starts to rotate, the center of gravity of the trapped gas will flow further away from $F_f$, further increasing the torque by $F_g$. This is a positive feedback situation; the rotation will accelerate until the device chamber is oriented similar to that shown in FIG. 5. At this time the aggregate density of the chamber, the float, the weight, and any gas and liquid in the chamber is less then the density of the chamber. This orientation of the device chamber, however, is not a stable state. Because the gas vent hole is now on top, the gas will vent out of the device chamber. As the gas leaks out, the magnitude of $F_g$ will start to decrease.

Figure 5:
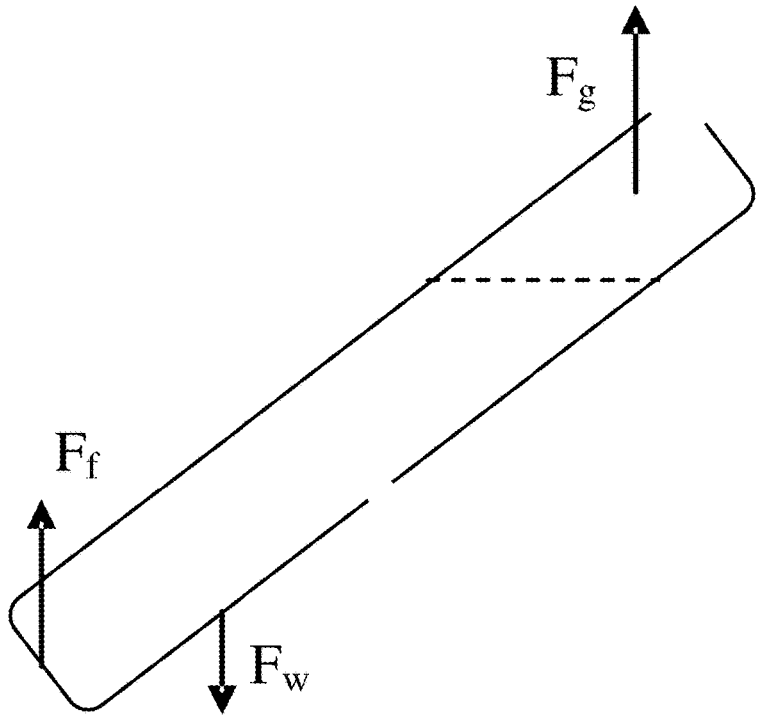
FIG. 5 shows the diagram where a large amount of trapped gas has rotated the device chamber.

As $F_g$ decreases, the net force pointing up and the torque to keep the device chamber in the orientation shown in FIG. 5 will decrease. Eventually, enough gas will leak out and the net force will point down, $F_w>F_g+F_f$, such that the device chamber will start to sink. The torque from $F_g$ will decrease and the device chamber will eventually return to the condition shown in FIG. 1 or 2 depending on whether all or part of the gas has time to vent out of the device chamber.

Note that it is possible that the float chamber never surfaces. This situation can be useful in some applications. For example, if the payload is the float and is tattered to the device chamber, the device will start to rise when $F_w<F_g+F_f$. The rise will continue until the payload reaches the surface. After that, the device chamber will remain submerged. This is possible because, at this point, the buoyant force of the gas, $F_g$, is the only upward force (the float surfaced and $F_f=0$) and it may be weaker than the weight, $F_w$. In this case, the device chamber remains submerged after the payload surfaces. Depending on the specific design, the float chamber can start to tilt before it ever reaches the surface. But it does not matter because the payload does surface.

The above process, steps 1 through 4, will repeat itself as long as gas is continuously produced and introduced into the device chamber.

A wide range of gas sources may be used with the device. Time-released capsules within a microbial medium may be used to slow down the initial evolution of gas, for example from 180 mL/day to 10-20 mL/day which would allow for the device to submerge and surface 2-3 times a day using the testing apparatus describe below. Furthermore, time-released capsules of glucose would not only slow down the gas production but it would also provide *C. acetobutylicum* with a constant supply of food source to sustain long deployment times. The device may also utilize nutrients scavenged from the natural littoral environment so that gas generation can be sustained for years or indefinitely.

Other gas sources include, but are not limited to, a compressed gas container, a chemically stored gas, or a source that produces gas by photosynthesis, decay of organic matter, or from natural or artificial vents. Chemically stored gases include, but are not limited to, metal hydrides (LiH, $NaAlH_4$, $LaNi_5H_6$ and $TiFeH_2$) and hydrogen stored in carbon nanoarchitectures (e.g. fullerenes and nanotubes), glass microspheres, or graphene.

A gas collector, such as an umbrella, may collect gas from a waste pond, an algae bloom, or a kelp forest. By monitoring how often the device surfaces, the activity or concentration of gas producing activity in these bodies of water can be determined. A gas sensor in the device may identify different process and their activity in producing the gas.

The gas inlet may be connected to a reaction chamber containing a reactant such that if a specific compound enters the chamber, gas will be produced. The float may then surface and transmit a warning signal. This embodiment may be used for leak detection in underwater pipes in remote areas. Any sensor that can trigger a gas valve from a compress gas source can make the floater surface and send out a warning signal.

The following example is given to illustrate specific applications. These specific examples are not intended to limit the scope of the disclosure in this application.

EXAMPLE

*Clostridium acetobutylicum* for Microbial Ballast—

To test the operation of the device, a device chamber was built using a 50 mL Falcon tube, a fishing bobbin as a float, and an Erlenmeyer flask with added weight as a counter weight. The microbe used was cultured in the Erlenmeyer flask.

In order to utilize microbial ballast for the periodic surfacing of a submerged device, the microbe must be able to produce gas under anaerobic conditions. For this reason *Clostridium acetobutylicum* was used as the model microbe; a gram-positive anaerobic bacterium known for its ability to produce hydrogen gas (Argun et al., *Int. J. Hydrogen Energy* 2009, 34, 2195-2200; Zhang et al., *Water Res.* 2006, 40, 728-734).

Figure 6:
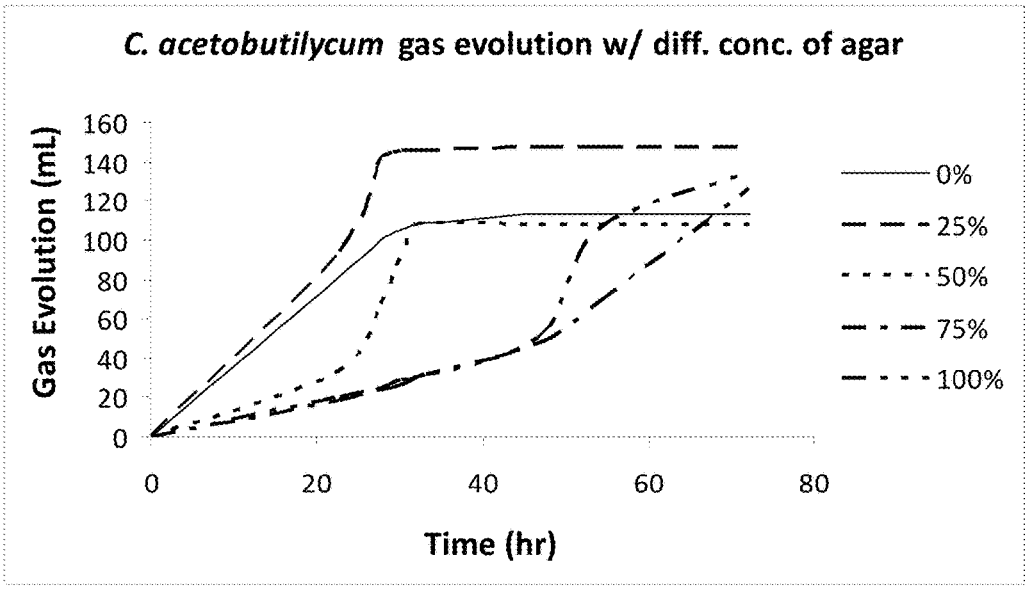
FIG. 6 shows gas production by different solid-phase agar cultures of *C. acetobutylicum.*

To determine if there was a difference in gas production in solid vs. liquid mediums, *C. acetobutylicum* was cultured in reinforced clostridal medium (OXOID CM0149) with four different concentrations of agar (100% agar was defined as the "typical" agar concentration in a solid medium support (1.5 g/100 mL) and therefore 75%, 50%, and 25% agar concentrations refer to a final agar concentration of 1.12, 0.75, and 0.38 g of agar per 100 mL, respectively) or no agar at all. The results (FIG. 6) conclude that *C. acetobutylicum* has the highest gas production when cultured in reinforced clostridal medium with 25% agar as the solid support. However, the results also indicate that after ~28 hrs there was a cessation of gas evolution; most likely due to the depletion of carbon food sources.

Figure 7:
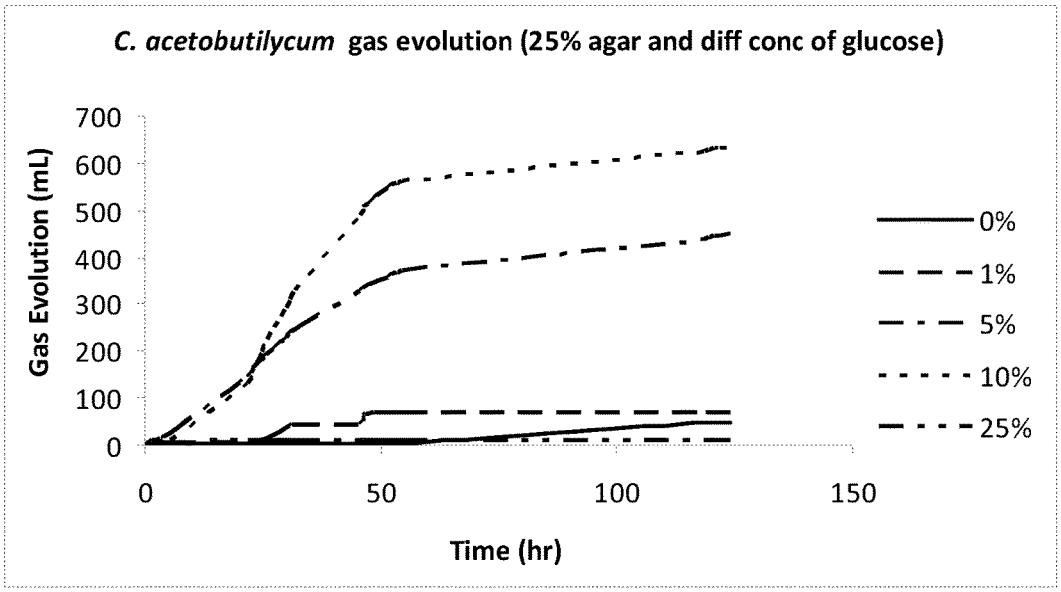
FIG. 7 shows gas production by different solid-phase agar cultures of *C. acetobutylicum* with varying glucose concentration.

For the continuation of gas evolution for sustained amounts of time, a food source may be present in the medium. For this study, glucose was chosen as the carbon source. A culture was grown on 25% agar reinforced clostrium medium with different concentrations of glucose (1, 5, 10, or 25 g of glucose per 100 mL culture) or no glucose at all. The production of gas was extended from 28 hrs to 50 hrs before it began to level off and then discontinue production after 120 hrs (FIG. 7).

As described earlier, the device chamber used was a 50 mL Falcon tube. Two 6 mm diameter holes were drilled in the Falcon tube. The gas vent hole was drilled at the tapered end of the Falcon tube. The fluid vent hole was drilled on the side of the tube approximately in the middle.

A common fishing bobbin, available in any fishing supply store, was used as the float. The float was attached to the cap of the Falcon tube with electrician tape via a ~5 mm long wire fishing line and a swivel. This allowed the float to rotate freely independent of the orientation of the device chamber.

The Erlenmeyer flask containing a *C. acetobutylicum* solid-phase culture was attached to the device chamber via a fishing line and a swivel so it could rotate independently of the orientation of chamber. The gas from the flask was introduced into the chamber through a plastic tube through the fluid vent hole. The tube from the flask was first bent into a loop before it entered the device chamber. This loop acted as a gas lock so that outside gas or fluid could not flow into the Erlenmeyer flask but excess gas could escape from the flask. The apparatus was tested in a 50 gallon water tank, where it surfaced and re-submerged every 30 minutes for 24 hours without any input energy beyond the chemical food supplied to the microorganisms.

Obviously, many modifications and variations are possible in light of the above teachings. It is therefore to be understood that the claimed subject matter may be practiced otherwise than as specifically described. Any reference to claim elements in the singular, e.g., using the articles "a," "an," "the," or "said" is not construed as limiting the element to the singular.

What is claimed is:

1. A device comprising:

a chamber having a gas inlet, a gas source coupled to the gas inlet, a gas vent, and a liquid vent;

a float and a weight coupled to the chamber; and a sensor, a communications device, or a global positioning system device coupled to the chamber;

wherein the gas source comprises a gas-producing microbe within the gas source;

wherein the float has a lower density than the chamber;

wherein the weight has a higher density than the chamber;

wherein the aggregate density of the chamber, the float, and the weight is greater than the density of the chamber; and wherein the gas inlet, the gas vent, the liquid vent, the float, and the weight are positioned on the chamber such that:

when the chamber is filled with and submerged in a liquid in which the chamber is neutrally-buoyant, the chamber is oriented to place the gas vent below the gas inlet; and when a gas is introduced through the gas inlet into the chamber that is filled with the liquid, the chamber pivots to raise the gas vent until a portion of the gas escapes from the chamber through only the gas vent.

2. The device of claim 1, wherein the density of the chamber is from about 0.5 to about 2.0 g/mL.

3. The device of claim 1, wherein the density of the chamber is from about 0.9 to about 1.2 g/mL.

4. The device of claim 1, wherein the gas inlet is positioned on the chamber between the gas vent and both the float and the weight.

5. The device of claim 1, wherein the gas inlet protrudes through the liquid vent.

6. The device of claim 1, wherein the gas-producing microbe is *Clostridium acetobutylicum*.

7. A method comprising:

providing the device of claim 1;

introducing gas from the gas source into the chamber;

allowing the chamber to pivot until a portion of the gas escapes from the chamber through the gas vent; and allowing the chamber to return to a position at which gas does not escape from the chamber.

8. The method of claim 7, wherein introducing the gas, allowing the chamber to pivot, and allowing the chamber to return are repeated two or more times.

9. The method of claim 7, wherein, when the gas escapes from the chamber, the aggregate density of the chamber, the float, the weight, and any gas and liquid in the chamber is less than the density of the chamber.

* * * * *